US008681009B2

(12) United States Patent
Pendse

(10) Patent No.: US 8,681,009 B2
(45) **Date of Patent: *Mar. 25, 2014**

(54) ACTIVITY TREND DETECTION AND NOTIFICATION TO A CAREGIVER

(71) Applicant: pomdevices, LLC, Durham, NC (US)

(72) Inventor: Ajit Pendse, Durham, NC (US)

(73) Assignee: Pomdevices, LLC, Durham, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/781,425

(22) Filed: Feb. 28, 2013

(65) Prior Publication Data

US 2013/0176128 A1 Jul. 11, 2013

Related U.S. Application Data

(63) Continuation-in-part of application No. 13/104,371, filed on May 10, 2011, now Pat. No. 8,427,302.

(60) Provisional application No. 61/345,836, filed on May 18, 2010.

(51) Int. Cl.
*G08B 23/00* (2006.01)

(52) U.S. Cl.
USPC ..... 340/573.1; 340/539.11; 340/573.4; 340/573.7

(58) Field of Classification Search
USPC ..... 340/573.1, 539.11
See application file for complete search history.

(56) References Cited

U.S. PATENT DOCUMENTS

| | | | |
|---|---|---|---|
| 4,956,825 | A | 9/1990 | Wilts |
| 5,101,476 | A | 3/1992 | Kukla |
| 5,146,562 | A | 9/1992 | Kukla |

(Continued)

FOREIGN PATENT DOCUMENTS

| | | | |
|---|---|---|---|
| WO | 2011/143326 | A1 | 11/2011 |
| WO | 2011/153373 | A1 | 12/2011 |
| WO | 2012/027661 | A1 | 3/2012 |

OTHER PUBLICATIONS

"The Aware Home: A Living Laboratory for Ubiquitious Computing Research" Cory D. Kidd, Robert J. Orr, Gregory D. Abowd, Christopher G. Atkeson, Irian A. Essa, Blair MacIntyre, Elizabeth Mynatt, Thad E. Starner and Wendy Newstetter. In the Proceedings of the Second International Workshop on Cooperative Buildings—CoBuild'99. Position paper; Oct. 1999; This paper explains some of our vision on technology—and human—centered research themes; 3 pages.

(Continued)

*Primary Examiner* — Kerri McNally
(74) *Attorney, Agent, or Firm* — Stolowitz Ford Cowger LLP

(57) ABSTRACT

In one example, a process includes receiving a plurality of first communications and a plurality of second communications, each first communication capturing activity of a patient or other monitored person using a first device at a different time and each second communication capturing activity of the patient or other monitored person using a second device at a different time. The process includes identifying a macro trend for all monitored activity of the patient or other monitored person based on data taken from the first and second communications. The process includes comparing data taken from a new communication from at least one of the first and second devices to the identified macro trend. A caregiver may be notified according to the comparison.

19 Claims, 2 Drawing Sheets

(56) References Cited

U.S. PATENT DOCUMENTS

| | | | | |
|---|---|---|---|---|
| 5,568,487 | A | 10/1996 | Sitbon | |
| 5,967,975 | A | 10/1999 | Ridgeway | |
| 6,078,924 | A | 6/2000 | Ainsbury | |
| 6,216,008 | B1 | 4/2001 | Lee | |
| 6,226,510 | B1 | 5/2001 | Boling | |
| 6,247,018 | B1 | 6/2001 | Rheaume | |
| 6,473,621 | B1 | 10/2002 | Heie | |
| 6,518,889 | B2 | 2/2003 | Schlager | |
| 7,111,044 | B2 | 9/2006 | Lee | |
| 7,236,941 | B2 | 6/2007 | Conkwright | |
| 7,254,221 | B2 | 8/2007 | Koch | |
| 7,367,888 | B1 | 5/2008 | Chen | |
| 7,586,418 | B2 * | 9/2009 | Cuddihy et al. | 340/573.1 |
| 7,616,110 | B2 * | 11/2009 | Crump et al. | 340/539.11 |
| 8,359,000 | B2 | 1/2013 | Fee | |
| 8,409,013 | B2 | 4/2013 | Pendse | |
| 8,427,302 | B2 | 4/2013 | Pendse | |
| 2001/0044337 | A1 | 11/2001 | Rowe | |
| 2001/0049609 | A1 | 12/2001 | Girouard | |
| 2002/0019747 | A1 | 2/2002 | Ware | |
| 2003/0114106 | A1 | 6/2003 | Miyatsu | |
| 2003/0119561 | A1 | 6/2003 | Hatch | |
| 2004/0067475 | A1 | 4/2004 | Niddrie | |
| 2004/0073460 | A1 | 4/2004 | Erwin | |
| 2004/0128163 | A1 | 7/2004 | Goodman | |
| 2004/0203961 | A1 | 10/2004 | Rustici | |
| 2004/0209604 | A1 | 10/2004 | Urban | |
| 2004/0247748 | A1 | 12/2004 | Bronkema | |
| 2005/0033124 | A1 | 2/2005 | Kelly | |
| 2005/0086082 | A1 | 4/2005 | Braunstein | |
| 2005/0132069 | A1 | 6/2005 | Shannon | |
| 2005/0136953 | A1 | 6/2005 | Jo | |
| 2005/0149359 | A1 | 7/2005 | Steinberg | |
| 2005/0151640 | A1 | 7/2005 | Hastings | |
| 2005/0215844 | A1 | 9/2005 | Ten Eyck | |
| 2005/0222933 | A1 | 10/2005 | Wesby | |
| 2006/0058048 | A1 | 3/2006 | Kapoor | |
| 2006/0066448 | A1 | 3/2006 | Berisford | |
| 2006/0089542 | A1 * | 4/2006 | Sands | 600/300 |
| 2006/0281543 | A1 | 12/2006 | Sutton | |
| 2006/0287068 | A1 | 12/2006 | Walker | |
| 2007/0066403 | A1 | 3/2007 | Conkwright | |
| 2007/0192738 | A1 | 8/2007 | Lee | |
| 2007/0200927 | A1 | 8/2007 | Krenik | |
| 2008/0009300 | A1 | 1/2008 | Vuong | |
| 2008/0027337 | A1 | 1/2008 | Dugan | |
| 2008/0108386 | A1 | 5/2008 | Hard | |
| 2008/0218376 | A1 | 9/2008 | Dicks | |
| 2008/0243544 | A1 | 10/2008 | Cafer | |
| 2009/0098925 | A1 | 4/2009 | Gagner | |
| 2009/0105550 | A1 | 4/2009 | Rothman | |
| 2009/0319298 | A1 | 12/2009 | Weiss | |
| 2010/0023348 | A1 | 1/2010 | Hardee | |
| 2010/0153881 | A1 | 6/2010 | Dinn | |
| 2011/0021247 | A1 | 1/2011 | Shih | |
| 2011/0053643 | A1 | 3/2011 | Shmunis | |
| 2011/0281597 | A1 | 11/2011 | Pendse | |
| 2011/0285529 | A1 | 11/2011 | Pendse | |
| 2011/0300945 | A1 | 12/2011 | Pendse | |
| 2011/0301969 | A1 | 12/2011 | Pendse | |
| 2012/0050066 | A1 | 3/2012 | Pendse | |
| 2012/0052833 | A1 | 3/2012 | Pendse | |
| 2013/0017846 | A1 | 1/2013 | Schoppe | |
| 2013/0190905 | A1 | 7/2013 | Pendse | |

OTHER PUBLICATIONS

United States PCT Office, "International Search Report of the International Searching Authority" for PCT/US11/36093; dated Aug. 23, 2011; 34 pages.

United States PCT Office, "International Search Report of the International Searching Authority" for PCT/US11/38960; dated Aug. 26, 2011; 38 pages.

United States PCT Office, "International Search Report and Written Opinion of the International Searching Authority" for PCT/US11/49332 filed Aug. 26, 2011; Dec. 19, 2011; 38 pages.

Stolowitz Ford Cowger LLP; Listing of Related Cases dated Aug. 14, 2013; 2 pages.

* cited by examiner

ACTIVITY TREND DETECTION AND NOTIFICATION TO A CAREGIVER

This application is a continuation of U.S. Utility patent application Ser. No. 13/104,371, filed May 10, 2011, which issued on Apr. 23, 2013 as U.S. Pat. No. 8,427,302, which claims priority from U.S. Provisional Application No. 61/345,836 filed on May 18, 2010, which are both herein incorporated by reference.

COPYRIGHT NOTICE

©2011 pomdevices, LLC. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

BACKGROUND OF THE INVENTION

In circumstances of remote care-giving, responsible parties often are not able to easily track daily activities. Changes in even the simplest activities such as walking and talking can indicate to trained individuals that health is declining or is in a sub-optimal state. Without access to this information, individuals are unable to get a large-scale picture of behavior over time, making diagnosing healthcare problems more difficult.

Current methods for tracking daily activity include pencil and paper tracking, persistent phone calls, and basic tools (such as spreadsheets) for getting daily snapshots of individuals. More technical solutions, such as Georgia Institute of Technology's "Aware Home" project, track motion and other activity through expensive devices such as force load tiles and video cameras.

SUMMARY OF THE INVENTION

In one example, a process includes receiving a plurality of first communications and a plurality of second communications, each first communication capturing activity of a patient or other monitored person using a first device at a different time and each second communication capturing activity of the patient or other monitored person using a second device at a different time. The process includes identifying a macro trend for all monitored activity of the patient or other monitored person based on data taken from the first and second communications. The process includes comparing data taken from a new communication from at least one of the first and second devices to the identified macro trend. A caregiver may be notified according to the comparison.

DETAILED DESCRIPTION OF PREFERRED EMBODIMENTS

Figure 1:
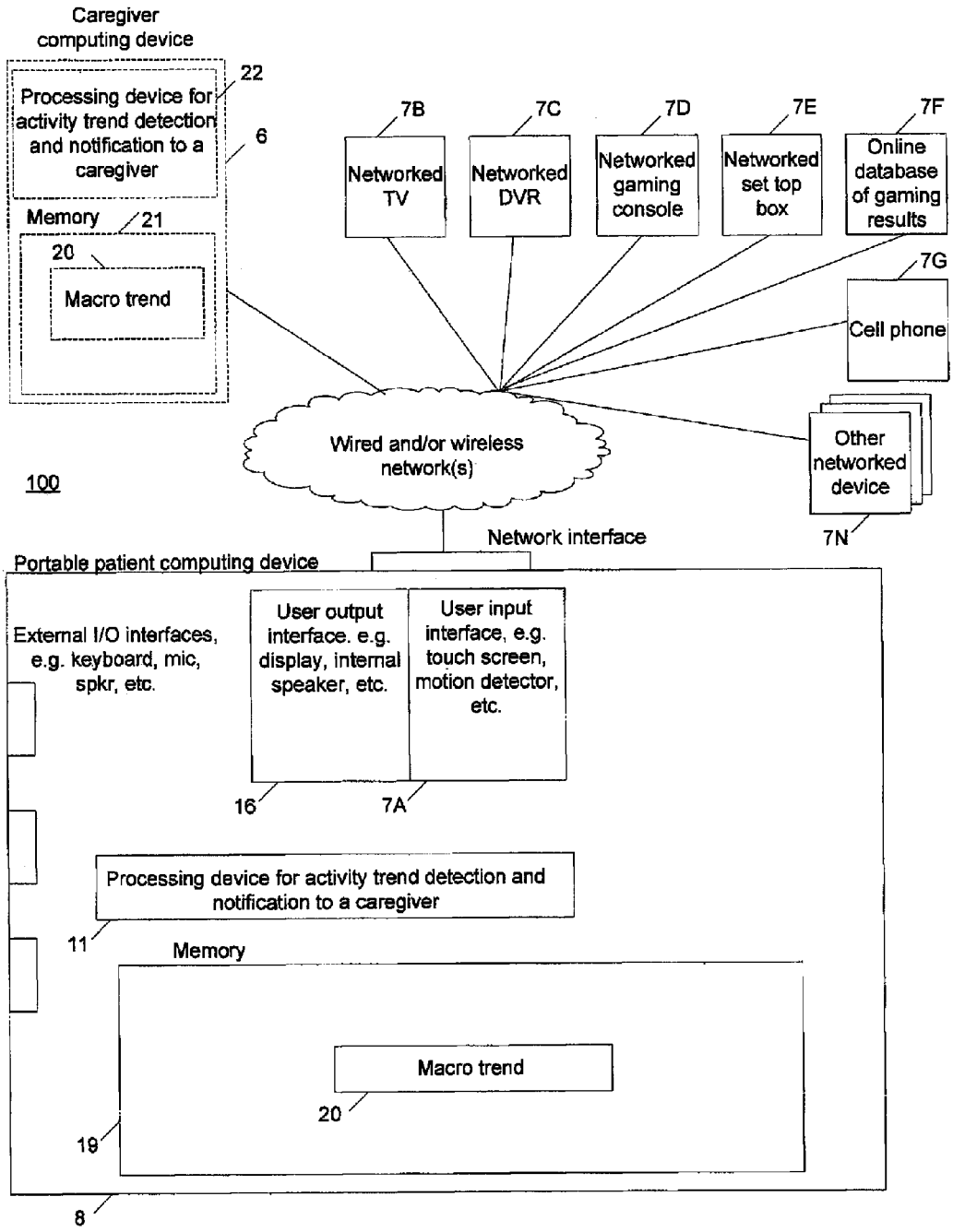
FIG. 1 illustrates a system for aided construction of SMS status messages to caregivers.

The system 100 includes a portable computing device 8 including a processing device 11 for activity trend detection and notification to a caregiver. The system 100 also includes one or more of the other networked device(s) 7B-N that are communicatively coupled to the processing device 8 over at least one network. The other networked devices 7B-N can include, but are not limited to, a TV (networked type), a gaming console (networked type), a database storing gaming results (typically any such databases are networked), a DVR (networked type), a set top box (networked type), a cell phone, a camera such as a wall or ceiling mounted camera, a microphone such as a wall or ceiling mounted microphone, etc. The portable computing device 8 is configured to aggregate user inputs collected by user interface 7A and/or the other devices 7B-N and identify a macro trend 20 based on the aggregated data. The processing device 11 stores the macro trend in a memory 19 for use in analyzing newly received data.

In the system 100, the sources of the data aggregated by the processing device 8 can be categorized into two broad categories as follows. One category includes devices which a patient or other monitored person actively controls via a user interface of the networked device. This category includes the personal portable device 8 (which the patient can actively interact with by sending text messages to friends and family in one example), online databases of gaming results (which represents active interaction with a gaming console), networked televisions (a patient actively interacts by selecting a channel and causing the TV to remain tuned to that channel for a particular time period), networked DVRs, networked set top boxes, networked gaming consoles, etc. and other multimedia devices. The source of the data can be the specific user input interface that the patient is actively interacting with, or in some cases a different user input interface of the same device, i.e. in the case of the portable device 8 the patient may be recorded via a microphone/camera user input interface of the portable device 8 while/when/during the user is actively interacting over another user input interface of the portable device 8 such as an attached keyboard or touch screen.

The "active device" category can be contrasted with another category of devices such as wall and ceiling mounted cameras and microphones distributed through a living area, which the patient does not actively interact with (these devices merely passively observe the patient). In these cases the patient is not actively interacting with the device that is the source of the data aggregated by the processing device 8.

In some examples, the processing device 8 aggregates data exclusively from source devices in the "active device" category. In other examples, the processing device 8 aggregates data from at least one source device in the "active device" category and at least one source device in the "passive device" category, e.g. from the networked TV 7B and a camera mounted on a wall/ceiling of a living area in one example.

The processing device 11 is configured to obtain information from a patient in direct and indirect ways. For example, the processing device 11 can be configured to display inquiries soliciting information from the patient (direct). The processing device 11 can also be configured to gather information indirectly, for example, by capturing motion and sound of the patient when the patient interacts with the computing device 8 and/or information from remote sources 7B-N (indirect).

The processing device 11 can be configured to, at various times, extract information from the networked devices 7B-N over one or more networks. The extracted information can include, but is not limited to, game information such as score/results, frequency of play, and duration of play; meta data from text communications sent via SMS or other similar protocols; and media viewing information such as information from a TV 7B, a set top box 7E, or a DVR 7C concerning viewing patterns. The various times for extraction could be scheduled or requested ad hoc by a caregiver computing device 6.

The processing device 11 is further configured to control the interface 7A (such as touch screen, motion detector, audio-in processing, etc.) to obtain motion and sound information of the patient. For example, the processing device 11 can obtain a captured motion of the patient and a captured speech of the patient when the patient is interacting with, for example text messaging, or a remote device. The processing device 11 may be further configured to control the graphical display on the output 16 to display graphics that solicit generation and transmission of text messages to a remote device, or to control an audio output to audibly solicit generation and transmission of text messages to a remote device.

Once the processing device 11 has the obtained the raw information from devices 7A-N as described above, in the present example the processing device 11 processes the information to identify a macro trend 20 for all monitored activity of the patient based on the raw information from devices 7A-N. The processing device 11 can identify the macro trend 20 by analyzing the raw information directly, or by first determining an average of the data per-device and then analyzing the averages, or any combinations thereof. It should be apparent that any known form of trend analysis can be used. Even in examples where the processing device 11 identifies the macro trend 20 by analyzing the raw information directly, the processing device 11 may also determining an average of the data per-device and store such averages (not shown) in the memory 19. In the present example, the macro trend 20 is stored in the memory 19 of the portable device 8 for later use by the processing device 11.

Having identified a macro trend 20, the processing device 11 can compare new information extracted from one of the devices 7A-N to the stored macro trend 20. If the new information varies from the macro trend 20 by a predetermined threshold, the processing device 11 transmits a certain type of notification (a health alert) to a caregiver. The transmitted notification can use SMS/text messaging, email, and/or other forms of communication. If the new information does not vary from the macro trend 20 by the predetermined threshold, the processing device 11 can still transmit a result of the trend analysis to the caregiver, although this would not be a health alert type notification.

The content of the uploaded notification can include results of the trend analysis to be used by the caregiver in monitoring cognitive health (or for that matter any form of health) of the particular user. In some examples, the notification may be configured to highlight new deviations from existing trends and/or to characterize such new deviations by associating at least some of the trends with symptoms and characterize symptoms.

The processing device 11 may update the stored macro trend 20 from time to time. An update can occur at a scheduled time no matter how much or how little new information is available, or may occur in response to receiving a certain amount of new information.

Having now described the portable patient computing device 8 and the processing device 11 in one example of the system 100, it is noted that other examples can include a caregiver computing device 6 containing processing device 22. Some or all of the functions described above by the processing device 11 can be performed by the processing device 22 as part of a distributed scheme.

For example, in one distributed scheme the processing device 11 can upload the raw information extracted from the devices 7A-N as it is obtained via SMS/text messaging, email, and/or other forms of communication. At times, the processing device 22 determines a macro trend 20 based on all of the raw information currently available on the computing device 6. The processing device 22 stores the macro trend 20 in the memory 21. Then, as the portable patient computing device 8 feeds new raw information to the computing device 6, the processing device 22 can compare the new raw information to the locally stored macro trend 20. According to the comparison, the processing device 22 can notify a caregiver, which may include displaying a message on a display attached to the computing device 6.

It should be apparent that the above example is just one example of distributing functions between the processing device 11 and the processing device 22. In other examples the functions can be distributed in specific ways.

The present disclosure includes daily (or other period) activity monitoring such as motion and sound through, for example, an audio recorder and a motion detector. The system then builds a database of information over time. The database can then be analyzed for trends and deviations from those trends, and the results could be communicated to appropriate parties such as caregivers or medical facilities.

Trends can be determined through a moving average algorithm such that both acute and longitudinal changes can be detected. Some specific embodiments would not only provide status and alerts, but could include recommended actions for both the caregiver and the patient.

Figure 2:
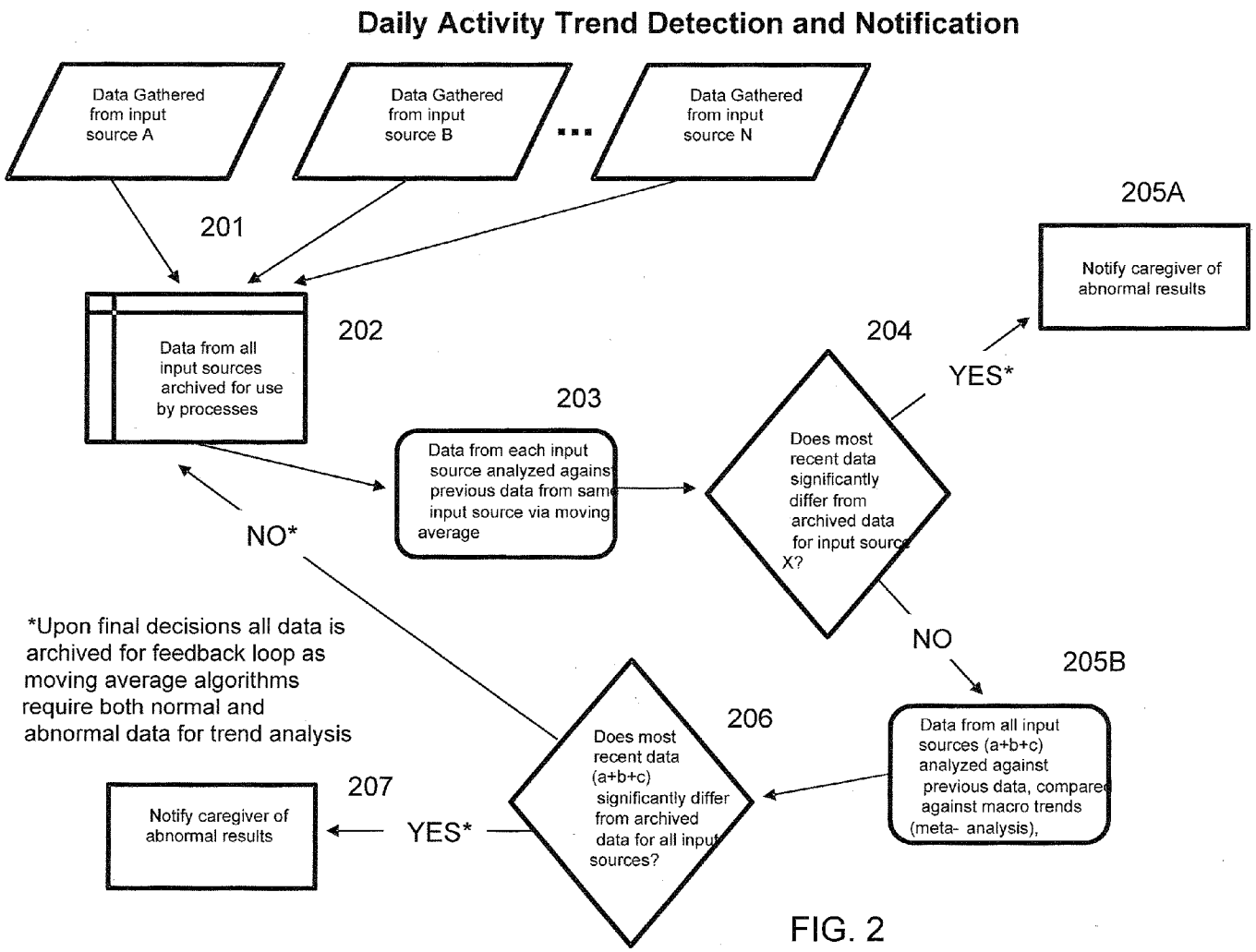
FIG. 2 illustrates an example method for using the caregiver computing device and/or the patient computing device shown in FIG. 1.

FIG. 2 illustrates an example method for using the caregiver computing device and/or the patient computing device shown in FIG. 1.

Referring to FIG. 2, a flowchart for a particular system is shown. In process 201, the processing device 11 (FIG. 1) gathers data originating from local or remote inputs. The data can be the audio/video files themselves, or data characterizing the audio/video files, or any other data gathered directly from the source or derived from data gathered directly from the source. In process 202, processing device 11 stores the gathered data.

In process 203, the processing device 11 identifies a moving average of each data group, e.g. a moving average for data gathered from a first source, a moving average for data gathered from a second source, and a moving average for data gathered from a third source, etc.

In process 204, the processing device 11 compares new data from a particular input source to the moving average for that particular input source. For example, new data from a first input source is compared to the moving average for that input source. If the comparison indicates a difference exceeding a preset threshold, then in 205A the processing device 11 generates and transmits a notification (and possibly a recommendation) over a network to alert a caregiver. The processing device 11 could also output locally, using a display of the portable device 8, a recommended course of action for the patient (which may or may not be different from any recommendation sent to the caregiver). Any remote notification 205A or local output may be held until the completion of processes 205B/206 (next paragraph), so that the notification 205A is sent only if the process reaches 207.

In process 205B, the processing device 11 aggregates data from all sources and generates a macro trend based on an analysis of the aggregation. In process 206, the processing device 11 compares new data aggregated from more than one input source (or possibly new data from a single input source) to the macro trend. If the comparison indicates a variation from the macro trend, then in process 207 the processing device 11 generates and transmits a notification over the network to alert a caregiver. It should be apparent that the processing device 11 can be configured to transmit an alert type notification (and possibly a recommendation) only if the variation exceeds a preset threshold. The processing device 11 could also generate a local notification for the patient instead of or in addition to the remote notification.

The macro trend analysis may also check a variance in the input data from one source and correlate that variance with other sources, and based on this comparison, determine whether or not a threshold limit has been reached. In real life this could mean that a person who normally spends most of the day in the living room may occasionally spend more time in the bedroom for that day watching TV. This lower activity detected in the living room might be compensated by the activity in the bedroom resulting in no notification, for example. Or, perhaps input from another source indicates more time spent in the bathroom, which would mean that the notification does get sent despite the living room time being compensated for by bedroom time.

It will be apparent to those having skill in the art that many changes may be made to the details of the above-described examples without departing from the underlying principles of the invention. The scope of the present invention should, therefore, be determined only by the following claims.

Most of the equipment discussed above comprises hardware and associated software. For example, the typical portable device is likely to include one or more processors and software executable on those processors to carry out the operations described. We use the term software herein in its commonly understood sense to refer to programs or routines (subroutines, objects, plug-ins, etc.), as well as data, usable by a machine or processor. As is well known, computer programs generally comprise instructions that are stored in machine-readable or computer-readable storage media. Some embodiments of the present invention may include executable programs or instructions that are stored in machine-readable or computer-readable storage media, such as a digital memory. We do not imply that a "computer" in the conventional sense is required in any particular embodiment. For example, various processors, embedded or otherwise, may be used in equipment such as the components described herein.

Memory for storing software again is well known. In some embodiments, memory associated with a given processor may be stored in the same physical device as the processor ("on-board" memory); for example, RAM or FLASH memory disposed within an integrated circuit microprocessor or the like. In other examples, the memory comprises an independent device, such as an external disk drive, storage array, or portable FLASH key fob. In such cases, the memory becomes "associated" with the digital processor when the two are operatively coupled together, or in communication with each other, for example by an I/O port, network connection, etc. such that the processor can read a file stored on the memory. Associated memory may be "read only" by design (ROM) or by virtue of permission settings, or not. Other examples include but are not limited to WORM, EPROM, EEPROM, FLASH, etc. Those technologies often are implemented in solid state semiconductor devices. Other memories may comprise moving parts, such as a conventional rotating disk drive. All such memories are "machine readable" or "computer-readable" and may be used to store executable instructions for implementing the functions described herein.

A "software product" refers to a memory device in which a series of executable instructions are stored in a machine-readable form so that a suitable machine or processor, with appropriate access to the software product, can execute the instructions to carry out a process implemented by the instructions. Software products are sometimes used to distribute software. Any type of machine-readable memory, including without limitation those summarized above, may be used to make a software product. That said, it is also known that software can be distributed via electronic transmission ("download"), in which case there typically will be a corresponding software product at the transmitting end of the transmission, or the receiving end, or both.

Having described and illustrated the principles of the invention in a preferred embodiment thereof, it should be apparent that the invention may be modified in arrangement and detail without departing from such principles. We claim all modifications and variations coming within the spirit and scope of the following claims.

The invention claimed is:

1. A system, comprising:

a portable device including a network interface to communicate over a network and a user interface to capture a motion or sound of an operator of the portable device; and a processing device coupled to the portable device, the processing device configured to:

capture a plurality of motions or sounds of the operator using the user interface of the portable device at different times;

receive communications over the network interface of the portable device, each communication indicating activity of the operator at a different time;

identify a macro trend for all monitored activity of the operator based on the data from the captured motions or sounds and the communications;

compare, to the identified macro trend, data taken from a newly captured motion or sound of the operator using the user interface of the portable device or data taken from a new communication received over the network interface; and transmit a notification addressed to a caregiver over the network using the network interface based on a result of the comparison.

2. The system of claim 1, further comprising a remote device, wherein the remote device is a multimedia device, and wherein each of the communications indicates an activity of the operator operating the multimedia device.

3. A system, comprising:

a processing device configured to:

receive a plurality of first communications, each first communication including data indicative of activity of a patient using a first device that was captured at a corresponding time;

receive a plurality of second communications, each second communication including data indicative of activity of a patient using a second device that was captured at a corresponding time;

identify a macro trend for all monitored activity of the patient based on the data from the plurality of first communications and the plurality of second communications;

analyze data received in a new communication from at least one of the first and second devices based on the identified macro trend; and transmit a notification to a caregiver responsive to results of the analysis.

4. The system of claim 3 wherein at least one of the first and second devices is a user interface of a personal portable device operated by the patient.

5. The system device of claim 4, wherein at least one of the first and second devices is a microphone or a camera of the personal portable device.

6. The system of claim 3, wherein at least one of the first and second devices is a user interface of a remote entertainment device.

7. The system of claim 3, wherein at least one of the first and second devices is a component of a television or a gaming console.

8. The system of claim 3, wherein the processing device is further configured to:

receive a new communication from the first device;

determine a difference between data taken from the new communication and an average of the data of the plurality of first communications or an average of the data from the plurality of second communications; and transmit a message if the difference exceeds a preset threshold.

9. The system of claim 3, wherein at least one of the first and second devices is a component of a media playing device.

10. The system of claim 3, wherein at least one of the first and second devices is a component of a messaging device.

11. The system of claim 3, wherein the processing device is located in a server networked to a personal portable device of the patient and the communications are received by the server from the personal portable device, and wherein at least one of the first and second devices is located in the personal portable device and at least one of the first and second devices is located in a media or communication device separate from the personal portable device.

12. A method, comprising:

receiving a plurality of first communications, each first communication including data indicative of activity of a patient using a first device that was captured at a corresponding time;

receiving a plurality of second communications, each second communication including data indicative of activity of a patient using a second device that was captured at a corresponding time;

identifying, using a processing device, a macro trend for all monitored activity of the patient based the data from the plurality of first communications and the plurality of second communications;

analyzing, using the processing device, data received in a new communication from at least one of the first and second devices based on the identified macro trend; and notifying, using the processing device, a caregiver according to the analysis.

13. The method of claim 12, wherein at least one of the first and second devices is a user interface of a personal portable device operated by the patient.

14. The method device of claim 13, wherein at least one of the first and second devices is a microphone or a camera of the personal portable device.

15. The method of claim 12, wherein at least one of the first and second devices is a user interface of a remote entertainment device.

16. The method of claim 12, wherein at least one of the first and second devices is a component of a television or a gaming console.

17. The method of claim 12, further comprising:

receiving a new communication from the first device;

determining a difference between data taken from the new communication and the data of the plurality of first communications or an average of the data from the plurality of second communications; and notifying the caregiver if the difference exceeds a preset threshold.

18. The method of claim 12, wherein at least one of the first and second devices is a component of a media playing device.

19. The method of claim 12, wherein at least one of the first and second devices is a component of a messaging device.

* * * * *